United States Patent [19]

Fedrigo

[11] 3,995,979

[45] Dec. 7, 1976

[54] APPARATUS FOR LUBRICATING MOULDS FOR BLANKS

[75] Inventor: Renzo Fedrigo, Banchette (Turin), Italy

[73] Assignee: Ing. C. Olivetti & C., S.p.A., Ivrea (Turin), Italy

[22] Filed: Nov. 1, 1974

[21] Appl. No.: 520,141

[30] Foreign Application Priority Data

Dec. 5, 1973 Italy ..... 70565/73

[52] U.S. Cl. ..... 425/78; 425/98; 425/174.8 E; 425/DIG. 115; 118/622; 118/629; 427/135

[51] Int. Cl.² ..... B22F 3/00

[58] Field of Search ..... 425/174.8 E, DIG. 115, 425/78, 96, 98, 100, 103, 107; 164/267; 427/133, 135; 118/622, 629

[56] References Cited

UNITED STATES PATENTS

| | | | |
|---|---|---|---|
| 2,821,164 | 1/1958 | Ingola | 427/135 X |
| 3,132,379 | 5/1964 | Crane | 425/98 X |
| 3,246,844 | 4/1966 | Lehman et al. | 118/629 X |
| 3,478,387 | 11/1969 | Ruekberg | 425/174.8 E |
| 3,536,514 | 10/1970 | La Fave et al. | 118/629 X |
| 3,687,588 | 8/1972 | Smith | 425/96 |
| 3,887,685 | 6/1975 | Stelzmuller | 425/DIG. 115 X |

FOREIGN PATENTS OR APPLICATIONS

| | | | |
|---|---|---|---|
| 1,937,500 | 11/1970 | Germany | 427/135 |
| 47-14267 | 10/1968 | Japan | 427/133 |

*Primary Examiner*—Ronald J. Shore

[57] ABSTRACT

An apparatus for lubricating the internal wall of moulds for blanks comprises a corona charger for charging electrically the lubricant which is then injected into the mould. This latter is maintained at an electric potential such as to attract the lubricant and cause it to be deposited on the inside walls of the mould.

8 Claims, 9 Drawing Figures

APPARATUS FOR LUBRICATING MOULDS FOR BLANKS

BACKGROUND OF THE INVENTION

The present invention relates to an apparatus for lubricating the inside walls of moulds for blanks, for example moulds for compacting powdered materials into blanks for sintered parts.

The technique of compacting powdered materials generally provides for the use of suitable presses equipped with at least one plunger, one mould or die and a device for pouring the powdered material to be compacted into the mould and commonly called a filling shoe.

By compressing the powder poured into the mould by means of the filling shoe with the plunger, there is obtained a compacted part or blank, technically called a "green" moulding, which is thereafter subjected to the sintering process.

During the stage of compaction of the powder, frictional resistances are manifested which cause the dissipation of part of the load applied by means of the plunger.

These frictional resistances comprise:

1. friction between plunger and mould;
2. friction between the grains of powder;
3. friction between the mass of powder and the walls of the mould.

While the frictional resistance which is manifested between the grains of the powder produces cold microwelds and therefore confers greater strength upon the blank, the frictional resistances between the plunger and the inside walls of the mould and between the mass of powder and the walls of the mould contribute only to dissipating part of the load applied by the plunger and therefore reduce the useful load applied to the powder.

DESCRIPTION OF THE PRIOR ART

One method for reducing the aforesaid losses of load provides for the prior mixing of the powder with lubricant, generally powdered zinc stearate. That is, the mould is filled with a mixture, in suitable percentages, of powder to be compacted and lubricating powder.

This kind of lubrication suffers a number of drawbacks. The presence of the lubricant wihin the compacted part prevents the formation of cold microwelds due to the frictional resistance between the particles of powder, thus prejudicing the strength of the green moulding. During the sintering there must also be provided a preliminary stage in which the zinc stearate is partially removed from the green moulding and this entails costly equipment and losses of time.

Methods are known for compacting powdered materials for parts to be sintered to obtain compact parts of high density greater than 7 kg/dm$^2$, for example by means of electrodynamic units. The presence of lubricating powder mixed with the material to be compacted prevents the attainment of this high density in the compacted part. In effect, the presence of the lubricant within the compacted part creates interruptions in the metallic mass and this is prejudicial to the density attainable during the compaction, both through the removal of part of the lubricant with respect to the metallic mass. The lubricating powder has, for equal bulk, a specific gravity of the order of magnitude of 1/10th that of the metal powder and, therefore, the theoretical density obtainable is lower than the case in which there is no lubricating powder within the metal powder.

As an alternative, there is known a method of lubricating only the inside walls of the mould to reduce the frictional resistances between the plunger and the mould and between the metal powder and the mould. The method provides generally for the deposit of a film of lubricant on the inside walls of the mould by spraying the lubricant inside the mould itself before the charging of the powdered material to be compacted.

This method, although it obviates the problems deriving from the prior mixing of the lubricant and the powder to be compacted, is of limited application inasmuch as it is usable only with moulds which define a particularly simple moulding cavity. In any case, the injected lubricant is not deposited uniformly on the walls.

Since this method of lubricating the walls only of the mould does not ensure either good adhesion of the lubricant to the walls or uniform deposit of the lubricant thereon, it renders the use of the method of compaction described hazardous.

SUMMARY OF THE INVENTION

According to the present invention there is provided an apparatus for lubricating moulds for blanks, wherein the lubricant is injected inside the mould, comprising charging means for charging the lubricant electrically and means operative to maintain the mould at an electric potential such as to attract the lubricant and cause it to be deposited on the inside walls of the mould.

In comparison with the other arrangements which are known, the apparatus according to the invention ensures uniform deposition of the lubricating film even in the case of moulds of complex shape and having zones which are not accessible with conventional sprays, ensures good adhesion of the lubricant to the walls and therefore renders practicable the method of compacting by means of high-speed presses.

BRIEF DESCRIPTION OF THE DRAWINGS

The invention will be described in more detail, by way of example, with reference to the accompanying drawings, wherein.

DETAILED DESCRIPTION OF THE PREFERRED EMBODIMENT

Figure 1:
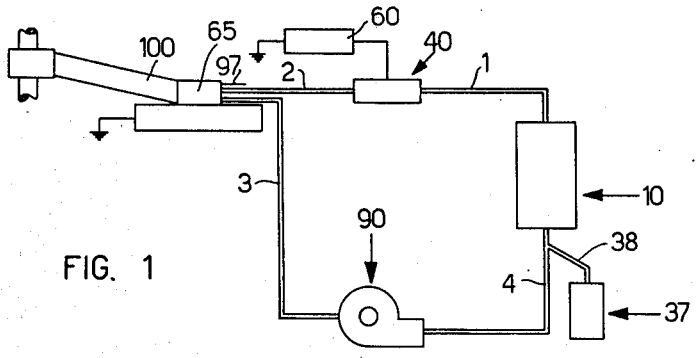
FIG. 1 is a diagram of an apparatus embodying the invention for lubricating moulds for blanks.

According to the preferred embodiment of the invention, the lubricating apparatus (FIG. 1) includes a reservoir 10 in which the lubricant is mixed with dry air coming from the reservoir 37 through the pipe 38, and which provides for drying the lubricant and forming an air-lubricant mixture. This mixture is caused to pass through a flexible pipe 1 into a corona charger 40 which, fed by a d.c. power source 60 having one terminal earthed, charges the lubricating particles electrically, and then the mixture is introduced via a flexible pipe 2 into a distributor 65.

The distributor is mounted on a filling or feed shoe 100 of the press at the side of the feed duct for the powdered material. The distributor is provided with a needle valve which can adopt two positions:

in a first position it enables the air/lubricant mixture to pass through the distributor and reach, via a flexible pipe 3, a recycling blower 90 which re-introduces it into the reservoir 10 via a flexible pipe 4;

in a second position it enables the mixture to be sprayed inside the mould through nozzles.

The mould is electrically earthed and thus the electrically charged particles of lubricant come to adhere uniformly to its inside walls.

Figure 2:
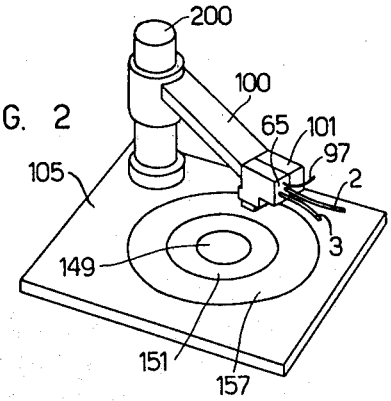
FIG. 2 is a partial perspective view of a detail of the apparatus wherein a distributor is mounted on the filling shoe of a compacting press.

FIG. 2 shows how the distributor 65 is off-set on the filling shoe 100. The filling shoe 100 is mounted on a pivot 200 fixed to the structure 105 of the press and overhangs the mould-bearing surface 157 and the mould 151. The distributor 65 is off-set at the side of the terminal portion 101 containing the duct from which the powder to be compacted issues. At the beginning of each compacting cycle, the filling shoe 100 is rotated around the pivot 200, through the medium of a system of levers and cams hereinafter described, from the inoperative position of FIG. 2, bringing in sequence into a position overhanging the filling opening 149 of the mould, first the distributor 65 in order to carry out the lubrication of the inside walls of the mould, and then the terminal portion 101 in order to carry out the loading of the powder.

Figure 3:
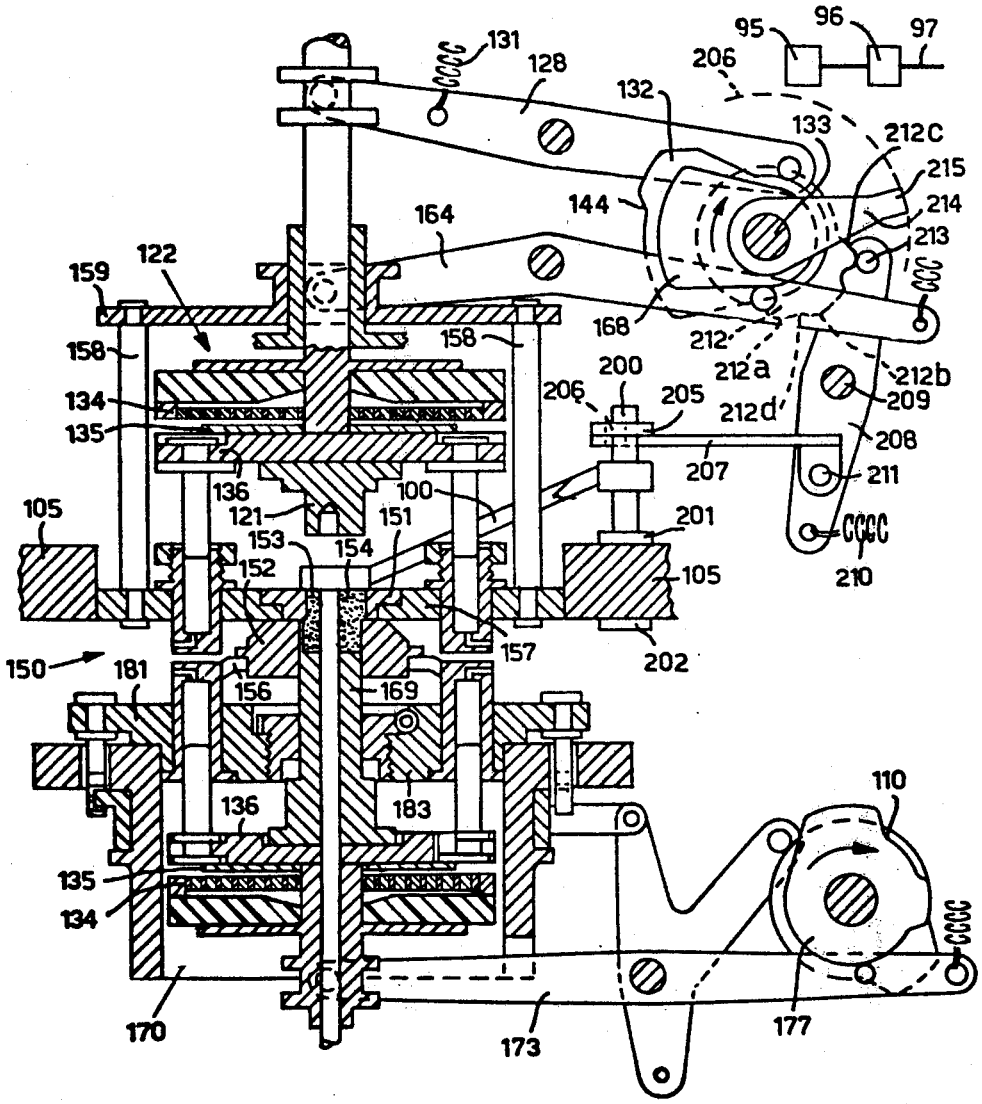
FIG. 3 is a section of a high-speed press equipped with a filling shoe and a corresponding control device.

FIG. 3 is a median section of a high-speed press for compacting powdered material at high density, which is described in our U.S. Pat. No. 935,799 and shows the feed mechanism for the movement of the filling shoe.

The press 150 includes a mould consisting of two portions 151 and 152 and is adapted to compact a part or piece constituted by two generally prismatic parts 153 and 154 of different sections. The part 153 is compacted by the plunger 121 carried by a structure 122 comprising a coil 134 fixed to the structure 122, and a plate 135 of conducting material connected to a plate 136 to which the plunger 121 is fixed.

The part 154 is compacted by the plunger 169 carried by a structure 170 identical to the structure 122 previously described. The coils 134 are connected to a battery of capacitors. The mould portion 152 is fixed to a frusto-conical part 156 of the fixed frame of the press. The mould portion 151 in turn is carried by a plate 157 slidable vertically on the frame 105.

In FIG. 3 the filling shoe 100 is in the working position, in the stage in which the powder is poured into the mould. The filling shoe 100 is mounted on a pivot 200 mounted on the structure 105 through the medium of the bushes 201, 202. The pivot 200 has a projection 205 disposed at 90° with respect to the axis of the pivot itself and cooperating through the medium of a pin 206 with an arm 207 fixed to the lever 208 by means of a pin 211. The lever 208 is pivoted on a spindle 209 and is adapted to co-operate through the action of a spring 210 and through the medium of a roller 213 with a cam 212 pivoted on the shaft 133.

At the beginning of the cycle, the mould portions 151 and 152 are joined together and the filling shoe 100 is rotated by means of the cam 212 and the lever 208. The cam 212 has two steps 212*a* and 212*b* connected by a plane portion 212*d*. During the rotation of the cam 212, the roller 213 encounters the first step; this causes the lever 208 to shift so as to bring the distributor 65 (FIG. 2) into correspondence with the filling opening 149 (FIG. 2) to effect the lubrication of the inside walls of the mould.

The roller 213 then encounters the second step and this causes the lever 208 to shift alternately to bring the terminal portion 101 of the filling shoe 100 into correspondence with the filling opening to effect the loading of the powder. The roller then encounters the depression 212*c*, causing the filling shoe to return in this way to the inoperative state (FIG. 2).

The compacting cycle is then initiated as described in the above-mentioned Patent. Through the medium of the levers 128 and 173 the cams 132 and 177 shift the two structures 122 and 170 in opposite directions so as to effect the pre-compacting of the powder by means of the plungers 121 and 169.

Thereafter, the two depressions 144 and 110 of the cams 132 and 177 allow the springs 131 and 176 to move the structures 170 and 122 away from the mould portions 151 and 152 for a predetermined distance. Because of the pre-compaction, the part or piece has by this time a sufficient cohesion, so that the moving away of the lower plunger does not damage the part itself.

A discharge of the capacitors is now produced and this is delivered substantially simultaneously to the two coils 134 in a manner known per se. The coils 134 now cause a rapid movement of the plates 136 in opposite directions, as a result of which the two plungers 121 and 169 effect the final compacting of the part by acting thereon from opposite sides.

The cam 132 now allows the spring 131 to bring the structure 122 back upwardly and the structure is followed by the plunger 121, while the cam 168 moves the plate 157 upwardly together with the mould portion 151 through the medium of the lever 164, the plate 159 and the columns 158.

By means of the lever 173, the cam 177 now shifts the structure 170 further upwardly together with the lower plunger 169, the sleeve 183 and the plate 181, as a result of which the moulded part is brought into the space between the two mould portions 151 and 152 and can be discharged from the press. The cams 168, 177 now bring the upper mould portion 151 back into contact with the lower mould portion 152 and the lower plunger 169 back into the inoperative position.

Figure 4:
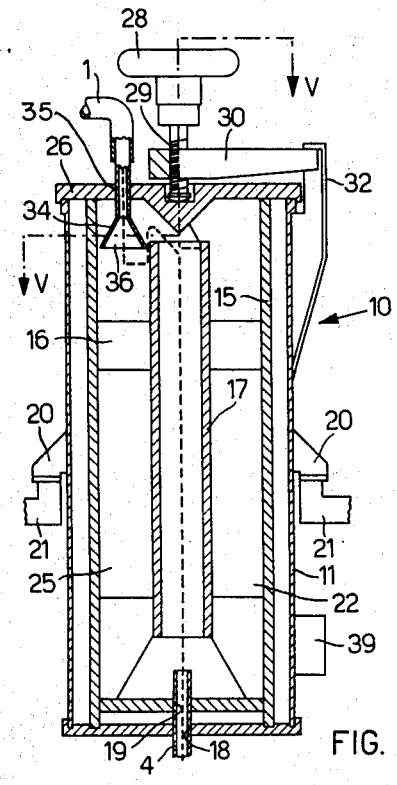
FIG. 4 is an axial section, taken in two planes at 90° to each other, of a reservoir forming part of the apparatus of FIG. 1.
Figure 5:
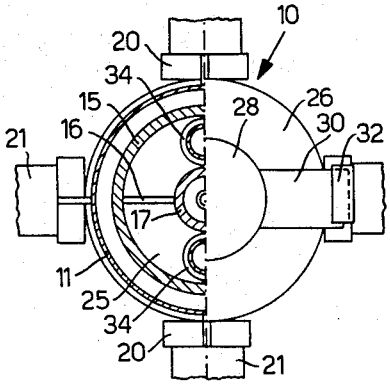
FIG. 5 is a partial cross-section of the reservoir of FIG. 4.

The reservoir 10 (FIGS. 4 and 5) is constituted by a rigid external structure 11 supporting internally a cylindrical container 15 of insulating material, for example PTFE. A tube 17, also of PTFE, is suspended inside the container 15 by means of the lugs 16. The flexible pipe 4 reaches the interior of the container 15 in the proximity of the tube 17 through a hole 18 in the external structure 11 and a hole 19 in the container 15. Dry air coming from a reservoir 37 is introduced through the pipe 38 into the flexible pipe 4 (FIGS. 1 and 4), the dry air being maintained in the reservoir 37, through known means, at a pressure slightly higher than the outside pressure, for example 1.3 atmospheres. The pressure may be varied through known means. The rigid external structure 11 is supported by an external structure (not shown) through the medium of the brackets 20 co-operating with the flexible couplings 21.

The lubricating powder 22, for example zinc stearate, is located in the hollow space 25 between the cylindrical container 15 and the tube 17 and, in accordance with the natural tendency of heaps or masses of powdered materials, is disposed in the proximity of the pipe 4.

The reservoir 10 is closed hermetically at the top by a cover 26. In fact, a handwheel 28 can be screwed by means of a threaded hub 29 into the crosspiece 30 co-operating with two diametrically opposed brackets 32 rigidly connected to the structure 11 and presses the cover 26 against the external structure 11 and the cylindrical container 15 by means of the end of the hub. Two funnels 34 disposed in the hollow space 25 are connected to the pipe 1 through the hole 35 in the cover 26.

During the operation of the apparatus, the flexible pipe 4 introduces a jet of dry air mixed with the recycled air-lubricating powder mixture in the proximity of the tube 17; more lubricating powder disposed as described in the hollow space 25 is entrained inside the tube 17.

The cover 26 is shaped internally so as to cause the mixture of air and powder issuing from the tube 17 to drop back close to the mouths 36 of the funnels 34, which are then able to suck up the aforesaid mixture. A vibrating device 39 of any type causes the reservoir 10 to vibrate continuously in a diametral direction, preventing the powder becoming packed in the hollow space 25.

Figure 7:
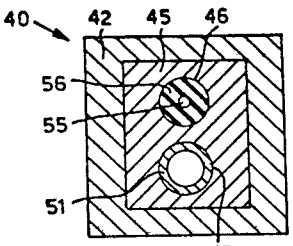
FIG. 7 is a section on the line VII—VII of FIG. 6.
Figure 6:
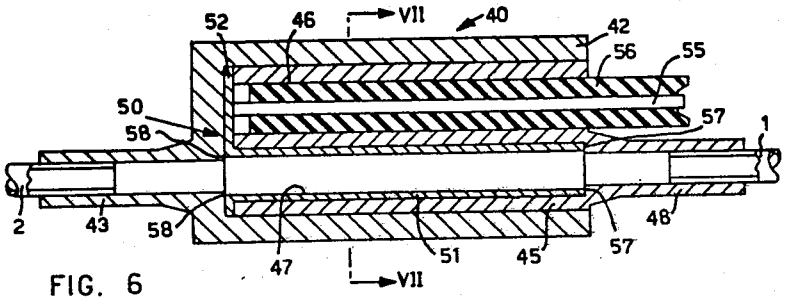
FIG. 6 is an axial section of the corona charger of the apparatus of FIG. 1.

The air-powder mixture is introduced through the flexible pipe 1 into the corona charger. The corona charger 40 (FIGS. 6 and 7) comprises an outer frame 42 of insulating material, for example PTFE, having an internal cavity in which is accommodated a container 45 of insulating material, for example PTFE, provided with two passages 46 and 47 of circular cross-section. In the container 45 there is arranged an electrode 50 constituted by a hollow cylinder 51 housed in the passage 47 and a flange 52 of conducting material accommodated between the container 45 and the outer frame 42. The frame 42 is provided with a hollow extension 43 connecting one opening of the hollow cylinder 51 with the flexible pipe 2. The container 45 is provided with a hollow extension 48 which connects the other opening of the hollow cylinder 51 with the flexible pipe 1.

An electric conductor 55 insulated by a sheath 56 is housed in the passage 46 and is in contact with the flange 52. The conductor 55 is supplied by a suitable source 60 (FIG. 1) of d.c. power of a value, for example of 50 kV, and having one terminal earthed.

Figure 9:
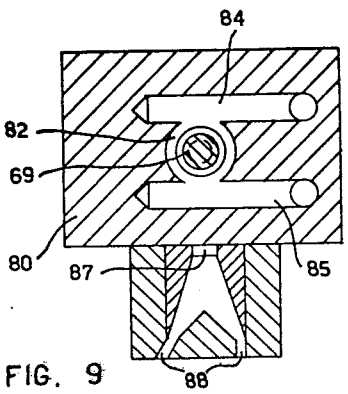
FIG. 9 is a section on the line IX—IX of FIG. 8.
Figure 8:
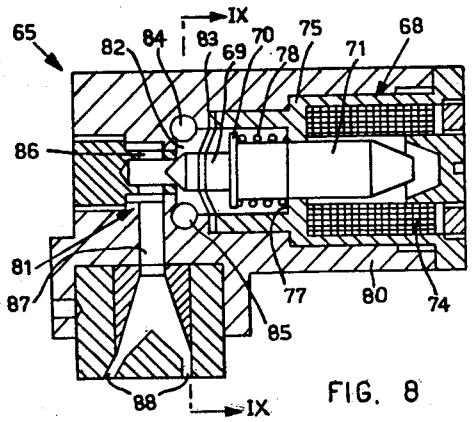
FIG. 8 is an axial section of the lubricant distributor of the apparatus of FIG. 1.

At the inlet edges 57 and outlet edges 58 of the hollow cylinder 51 a strong ionization of the air is obtained; the ions produced bombard the particles of lubricant in suspension in the air and charge them electrically. The electrically charged air-lubricating powder mixture reaches the distributor 65. The distributor 65 (FIGS. 8 and 9) comprises a needle valve 68, the stem 69 of which is integral via a flange 70 with a cylindrical body 71 which constitutes the armature of an electromagnet 74 and is shifted to the right (FIG. 8) when the electromagnet 74 is energised.

The electromagnet is housed in a cylindrical structure 75 which is provided with an internal shoulder 77. A spring 78 connects the flange 70 with the shoulder 77, urging the stem 69 to the left. The structure 75 is housed in an outer casing 80.

The valve 81 has an inner chamber 82 of cylindrical form closed towards the electromagnet by a gasket 83 fixed between the inner structure 75 and the outer casing 80. The inner chamber 82 communicates with a duct 84 for bringing up the air and lubricant mixture and with a duct 85 for the recycling of the mixture through the flexible pipe 3 when the needle valve is closed. The inner chamber 82 is in communication, through an internal groove 86 formed in the casing 80, with another duct 87 which supplies two nozzles 88 adapted to inject the air and lubricant mixture when the needle valve is open. In fact, the mixture of dry air and lubricant is maintained within the circuit at a pressure higher than atmospheric pressure. The unused mixture of air and lubricant is sucked through the duct 85 and the flexible pipe 3 (FIG. 1) by the recycling blower 90 of centrifugal type, which provides for the delivery thereof back to the reservoir 10 through the flexible pipe 4, thus renewing the cycle. The head of the blower is, for example, 0.03 atmosphere. The lubricating powder mixture is kept always in circulation. The head of the blower may be varied by known means, therefore varying the recycling velocity of the mixture of air and lubricant until the latter is prevented from blocking the pipes.

The electromagnet 74 is energised by square waves through the line 97 leading from the generator 96 (FIG. 3), which is enabled by a proximity sensor 95.

The proximity sensor 95 is positioned opposite the circumference 206 described by the end 215 of the lever 214 fixed to the shaft 133 and is triggered when the end 215 is in the position of minimum distance.

The position of the lever 214 of the shaft is synchronised with the position of the cam 212 so that when the end 215 is located in the position of minimum distance from the proximity sensor 95 the roller 213 is located at the beginning of the plane portion 212*d*, that is at the same moment when the distributor is positioned above the loading opening 149 of the mould by the filling shoe. The proximity sensor 95 enables the generator 96 to emit a square wave. The duration of the square wave characterises the time of opening of the valve, and therefore by regulating the amplitude of the square wave it is possible to vary the quantity of lubricant injected. The quantity of lubricant injected may also be varied by varying the pressure of the dry air in the reservoir 37 (FIG. 1). In this way, it is possible to adjust the quantity of lubricant injected as a function of the shape and size of the compacting mould used.

As long as the electromagnet 74 is de-energised, the stem 69 urged by the spring 78 prevents the air-lubricant mixture coming from the duct 84 supplying the duct 87 and, therefore, the nozzles 88. The mixture coming from the duct 84 returns through the duct 85 and the flexible pipe 3 to the aspirator 90 to be recycled afresh.

When the distributor 65 is positioned above the loading opening of the mould, the electromagnet 74 is fed by a square wave, the cylindrical body 71 is attracted to the right and the duct 84 is thus placed in communication with the duct 87. The air-powder mixture can be injected inside the mould through the nozzles 88. The lubricant particles charged, for example, positively are attracted by the mould, which is electrically earthed, for example, and therefore covers the inside walls of the mould with a uniform film whatever shape they may have.

In the apparatus embodying the invention the air and lubricant mixture is recycled continuously, thus permitting prompt delivery of the mixture to the nozzles when required.

I claim:

1. In a press for compacting powdered material for sintered parts of high density, comprising a mould and at least one plunger adapted to be actuated by a cyclic shaft to effect a preliminary compacting, an electrodynamic unit for the high density compacting and including an apparatus for lubricating the mould comprising a reservoir for mixing the lubricant with dry air, a corona charger connected to said reservoir for charging electrostatically the mixture of said lubricant and dry air, a distributor connected to said corona charger actuatable for injecting said mixture into said mould, means operative to maintain the mould at an electric potential such as to attract the lubricant and cause it to be deposited on the inside walls of the mould, an element carried by the said shaft for actuating said injecting distributor in a predetermined time relationship with respect to said compactings, and a recycling blower connected between said distributor and said reservoir so as to keep said mixture in circulation.

2. An apparatus for lubricating a mould for blanks, comprising:

a reservoir for mixing the lubricant with dry air, a corona charger connected to said reservoir for charging electrostatically the mixture of said lubricant and dry air, a distributor connected to said corona charger for injecting said mixture into said mould, means operative to maintain the mould at an electric potential such as to attract the lubricant and cause it to be deposited on the inside walls of the mould, and a recycling blower connected between said distributor and said reservoir so as to keep said mixture in circulation.

3. An apparatus for lubricating moulds for blanks comprising a reservoir for mixing dry air with the lubricant, a corona charger for electrically charging the mixture of air and lubricant, said reservoir being connected to the corona charger, injecting means for injecting said mixture of air and lubricant inside the mould, said injecting means including a distributor connected to said corona, a valve connected to the distributor and actuatable to control the injection of the mixture, means operative to maintain the mould at an electric potential such as to attract the lubricant and cause it to be deposited on the inside walls of the mould, a recycling blower connected between the distributor and the reservoir, and actuating means for actuating said valve so as to cause said blower to keep the dry air and lubricant mixture continuously in circulation when the valve is not actuated, while the mixture is injected into the mould when the valve is actuated.

4. An apparatus according to claim 3, for a powder compacting press including a mould filling shoe, wherein the distributor is provided with nozzles and is connected to the corona charger and to the recycling blower through flexibles pipes, the distributor being mounted on the mould filling shoe.

5. An apparatus according to claim 4, wherein said distributor is mounted on the shoe at the side of the feed duct for the powder, comprising oscillating means for giving to the filling shoe an oscillating movement for effecting the lubrication of the mould and the loading of the powder in sequence at the beginning of each compacting cycle.

6. An apparatus according to claim 5, wherein the oscillating means comprise a rotatable cam and cam following means, said cam being provided with two prominences connected by a portion of constant curvature, the first prominence causing the positioning of the nozzles in the loading opening of the mould and the second prominence causing the positioning of the feed duct for the powder in the loading opening of the mould.

7. An apparatus according to claim 6, wherein said actuating means comprise an electromagnet, and a generator for energizing said electromagnet to actuate the valve when the distributor nozzles are positioned in the loading opening of the mould, the generator being enabled to emit a square wave of predetermined length by a proximity sensor triggered by an element bodily rotatable with said cam.

8. Apparatus according to claim 7, wherein said element is positioned in a plane parallel to the plane of the cam so as to produce the opening of the valve when the distributor nozzles are positioned in the loading opening of the mould.

* * * * *